US008079499B2

(12) United States Patent
Juteau et al.

(10) Patent No.: US 8,079,499 B2
(45) Date of Patent: Dec. 20, 2011

(54) DISPENSING JAR FOR VISCOUS FOOD PRODUCT

(76) Inventors: W. David Juteau, Frankfort, NY (US); Elaine M. Juteau, Frankfort, NY (US)

( * ) Notice: Subject to any disclaimer, the term of this patent is extended or adjusted under 35 U.S.C. 154(b) by 796 days.

(21) Appl. No.: 12/146,041

(22) Filed: Jun. 25, 2008

(65) Prior Publication Data

US 2009/0321478 A1 Dec. 31, 2009

(51) Int. Cl.
*B67D 7/60* (2010.01)

(52) U.S. Cl. ..... 222/390; 401/75; 401/175

(58) Field of Classification Search ..... 222/390, 222/386; 401/68, 75–78, 172–175; 184/38.1–38.4
See application file for complete search history.

(56) References Cited

U.S. PATENT DOCUMENTS 217,695 A * 7/1879 Knoblauch ..... 222/205
348,451 A * 8/1886 Cole ..... 184/38.4
1,067,924 A * 7/1913 Johnson ..... 401/170
1,207,303 A * 12/1916 Lees ..... 184/38.4
1,437,169 A * 11/1922 Critchlow ..... 222/390
2,123,731 A * 7/1938 Kahn ..... 222/390
2,485,467 A * 10/1949 Weisbaum ..... 222/390
2,656,953 A 10/1953 Rich
2,728,494 A * 12/1955 Hobson ..... 222/386.5
5,082,135 A 1/1992 DeCoster
6,820,776 B2 11/2004 Hemming et al.
6,918,511 B1 7/2005 Spatz et al.
7,207,739 B1 4/2007 Preteroti
7,270,495 B1 9/2007 Preteroti
2009/0294484 A1* 12/2009 Avairis ..... 222/390

* cited by examiner

*Primary Examiner* — J. Casimer Jacyna
(74) *Attorney, Agent, or Firm* — Bernhard P. Mollderm, Jr.

(57) ABSTRACT

A jar or bottle container for dispensing food items or other products that may have a liquid component and a solid component has a platform that is supported on a threaded post on the interior of the jar. A base seated at an open bottom of the jar body is turned to rotate the post and elevate the platform to push the food item upward. The platform has a ring seal and radial lip or tooth structure that rides in vertical channels formed in the inner wall of the jar body. A weight or ballast may be present in the base.

7 Claims, 4 Drawing Sheets

DISPENSING JAR FOR VISCOUS FOOD PRODUCT

BACKGROUND OF THE INVENTION

This invention is directed to a food product container that is especially suited for food products that are viscous mixtures of solid and liquid components, such as mayonnaise, peanut butter, jam, sauces, for example, and is more particularly directed to a jar that includes a platform that can be made to rise to push the product up towards the mouth of the jar for easy dispensing.

The invention is more specifically concerned with an Easy Glide Jar that is designed to allow the user to push the jar contents up to the top of the jar as the contents are consumed, both for convenience and to avoid waste.

Peanut butter, jam, sauces, mayonnaise, and other semi-liquid food products are typically stored in glass or clear plastic containers (i.e., jars) with twist off lids. As the food product is consumed, the remaining product resides at the bottom of the jar, and it is often difficult to reach in with a spoon or knife and remove that product. Accordingly, some means has been needed to push the contents up towards the mouth of the jar, but no suitable push-up system has been proposed for such viscous semi-liquid food products. There have been twist dispensers for various products, such as deodorant or other personal health products (See U.S. Pat. Nos. 7,270,495; 7,207,739; 6,918,511; and 5,137,185). These dispenser have used a threaded post that is rotated to move a cup so as to move a material, that is in stick form, to an open end of a tube. These dispenser containers are not adapted for viscous semi-liquids in the nature of jams, sauces, butters, or other products that have a liquid component that can settle out, and which would easily leak or drip past the elevator cup portion of the device. An example of a dispenser for shortening is shown in U.S. Pat. No. 2,656,953. That dispenser employs a rotary threaded post to drive a disk member down and urge the shortening through a dispensing tube. None of these previously proposed dispensing containers are particularly well suited for storing and dispensing peanut butter, sauce, jam, or any food product of that nature that comprises a liquid component and a solid component.

OBJECTS AND SUMMARY OF THE INVENTION

Accordingly, it is an object of this invention to provide a simple and effective design for a food product jar that facilitates dispensing the product, even when the contents are mostly depleted, and which avoids the drawbacks of the prior art.

It is another object to provide a food product jar or container that dispenses the food product up from the bottom of the container, to make access to the product as easy for the last of the contents as it is at the beginning when the container is full, thus eliminating waste and mess.

It is a further object to provide a dispensing jar or container that is suitable for such foods as peanut butter, mayonnaise, jams, jellies, sauces, condiments and other solid-liquid products, as well as mostly free-liquid products such as pickles and olives.

It is also an object to provide a dispensing container that can be used for similar non-food products, such as shampoo, conditioner, hand cream, body wash, liquid soap, dishwashing detergent, caulk, furniture polish, etc.

According to one aspect of this invention, a food product jar is constructed in appearance much like a standard jar, except that the bottom is replaced with a rotary base that is fitted onto the bottom end of the generally cylindrical jar body. A sturdy plastic platform has a female threaded opening that receives a threaded post, i.e., auger, that is supported on the base and extends along the axis of the jar body. The base is rotated to move the platform and push the contents up towards the mouth of the container.

The jar body has a plurality of vertical channel recesses or tracks formed on its inside cylindrical wall. The platform is slidable along the inside of the jar body to urge said food product towards the mouth of the jar body. To accommodate the liquid or semi-liquid nature of the food product and yet achieve an easy glide motion, the platform member is in the form of a generally rigid disk having a central female threaded opening engaging the threaded post. The disk has an annular peripheral recess, and a flexible seal ring is seated in the peripheral recess and is slidably biased against the inside cylindrical wall of said jar body. There are a plurality of radially extending lips, or equivalent tooth structure, which project into the vertical channel recesses or tracks so that the platform does not rotate. The platform could be constructed so as to rotate in the jar, in jars that require that feature. Respective flexible seal members are positioned on the radial lips and form a slidable seal against the associated channel members. As the base is rotated, the platform glides upward, but the seal arrangement keeps the food product from leaking past into the space below the platform.

Preferably there is at least one pair of vertical channel recesses positioned diametrically opposite one another and with the platform having at least one pair of radial lips positioned diametrically opposite one another. In a preferred embodiment the jar member has four of these vertical channel recesses at ninety degree intervals and the platform likewise has four lips positioned at ninety degree intervals. The base can be rotated by grasping the ribbed rim of the base or bottom. This can be easily implemented on jars of smaller size.

As a means of keeping the jar or container from tipping as the contents are depleted, the rotatable base can include a weight or ballast member to provide weight to the bottom of the container.

In a preferred embodiment, the rotary base is contained within the cylindrical body at its bottom end. The jar body can have an internal annular ledge formed at the bottom thereof for retaining the base in the bottom end. The base preferably has a recessed handle grip formed at its bottom side, so that the base can rest on a shelf or other flat surface, but can be easily turned by hand when needed.

In a preferred version of this container, the jar body has a shoulder leading to a neck of smaller diameter than the main cylindrical portion, with the mouth formed at the upper end of the neck. There is a threaded rim on the neck, and a screw-on lid threaded to mate with the threaded rim.

The above and many other objects, features, and advantages of this invention will present themselves to persons skilled in this art from the ensuing description of preferred embodiments of this invention, as described with reference to the accompanying Drawing.

DETAILED DESCRIPTION OF THE PREFERRED EMBODIMENT(S)

Figure 1:
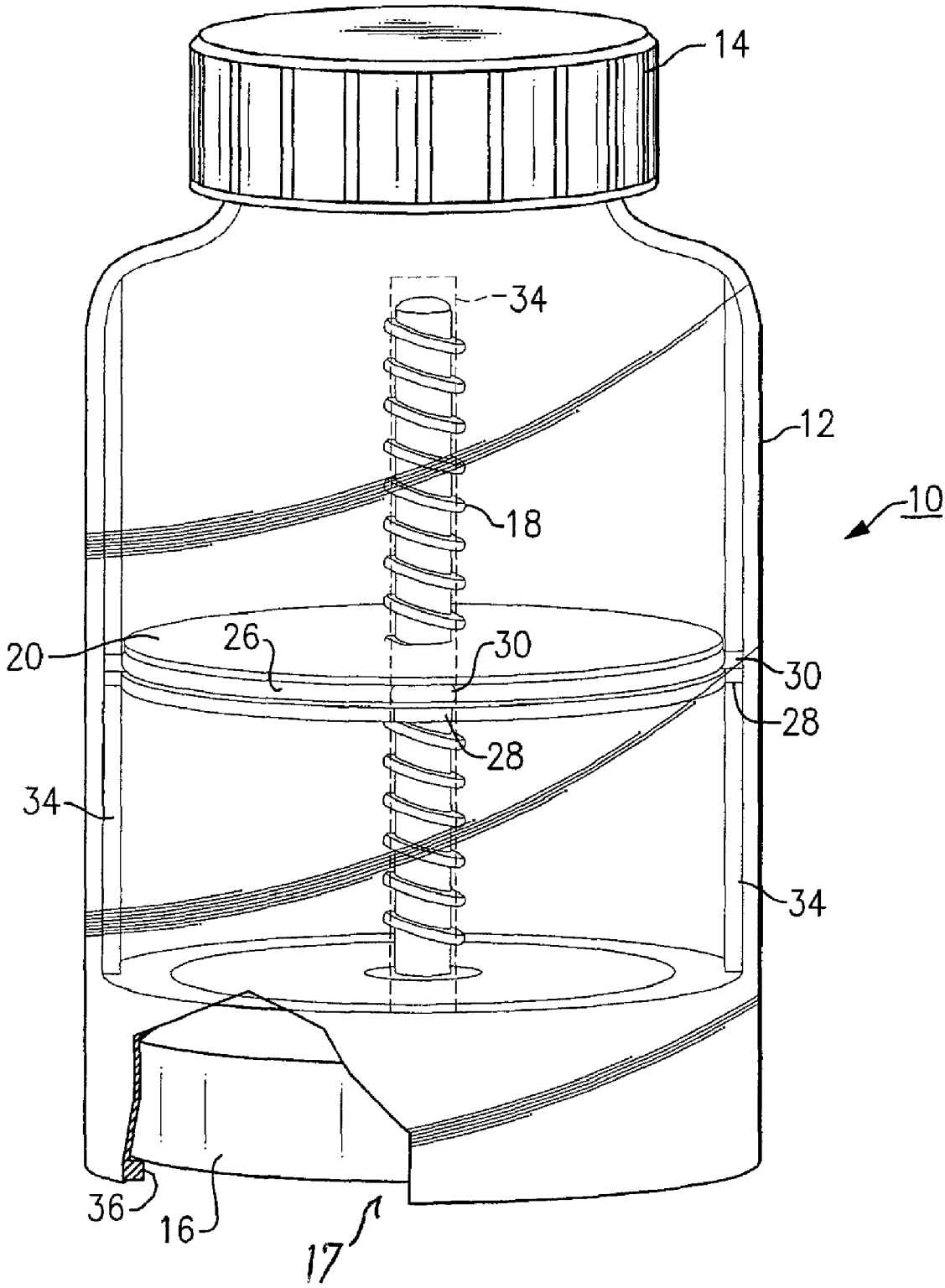
FIG. 1 is a perspective view of a peanut butter, jam, or mayonnaise container according to an embodiment of this invention.

With reference to the Drawing, FIG. 1 shows an embodiment of the food product container or jar 10 of the present invention, as a jar body 12 of generally cylindrical shape and formed of glass or of a suitable food-grade rigid plastic material, with a screw-on lid 14 covering the jar mouth at the upper end, and with a base 16 fitted into an open bottom end 17 of the jar body 12. The base 16 is in the form of a disk, also of a food grade plastic material, and can be gripped by the consumer and turned by hand. A threaded post 18 or screw member extends vertically, i.e., along the center axis of the jar body 12, and is mounted or affixed onto the rotary base 16 so that it rotates when the base 16 is turned. There is a generally horizontal platform 20 that is designed to glide up and down within the interior of the jar body, and is held against rotation by channel and lip structure that will be discussed shortly, and has a central threaded opening that fits onto the post 18, so that the platform moves upward when the base is turned to bring the food product up towards the mouth of the jar. There is also a seal arrangement between the periphery of the platform 20 and the inside cylindrical surface of the jar body 12, so that the liquid component of the food product is kept from leaking or seeping into the space between the platform 20 and the base 12. The seal structure does not inhibit the vertical motion of the platform when the base 12 is rotated or turned.

Figure 2:
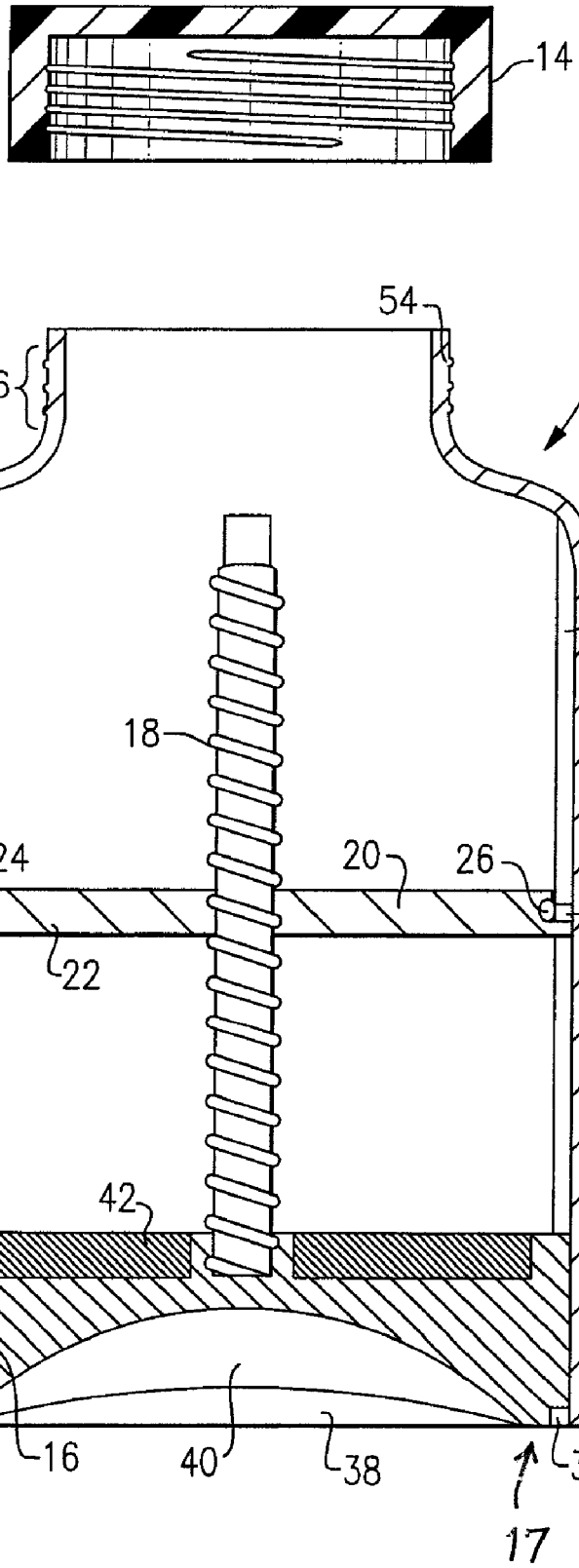
FIG. 2 is an elevational cross-section view of this embodiment.
Figure 3:
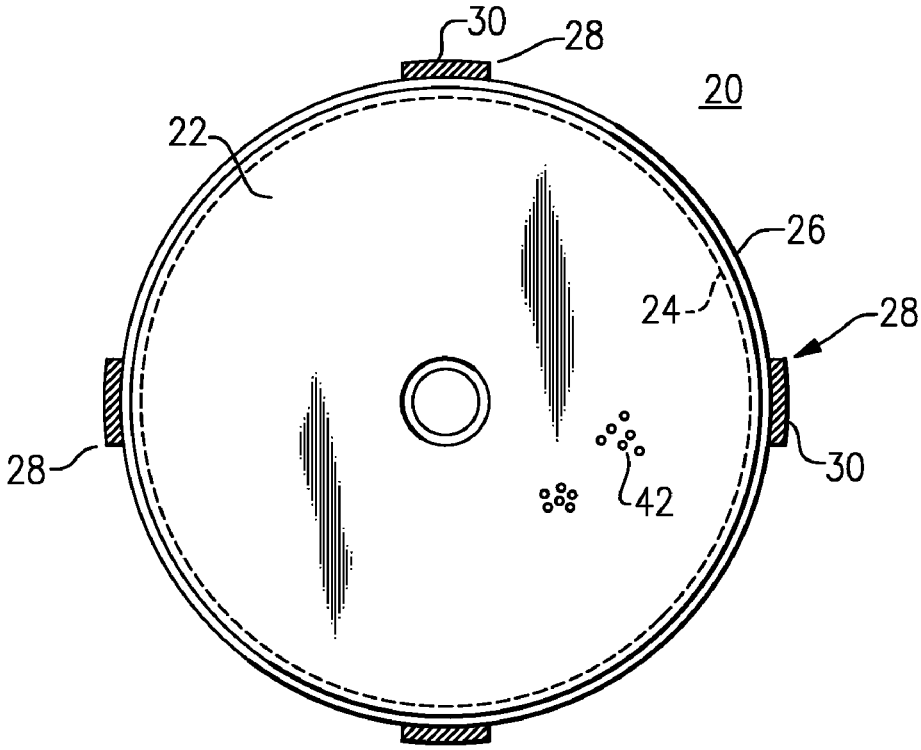
FIG. 3 is a top plan view of the platform member of this embodiment.

As shown in more detail in FIGS. 2 and 3, the platform 20 is in the form of a disk 22 with an annular peripheral groove 24, and a ring seal 26 (of a suitable food-grade elastomer) is seated in this groove 24. The seal 26 is biased against the internal cylindrical surface of the jar body 12.

At the peripheral edge of the platform 20 there are a plurality of lips 28 that extend radially out beyond the disk 22. Preferably, there is at least one pair of diametrically opposed lips, and in this embodiment there are four lips 28 situated at ninety-degree intervals around the platform 20. Each lip 28 also has a sealing layer 30 of a food-grade elastomeric material at its upper surface. As shown in FIG. 3, the platform has a central threaded opening 32 that mates with the threaded post 18.

The interior wall of the jar body 12 has a plurality of vertical recesses or channels 34 that serve as tracks or keyways in which the lips 28 of the platform ride. There are a number of these channels 34 that correspond to the number of lips 28, and in this embodiment there are four channels 34 situated at ninety-degree intervals around the center axis of the jar body. Details of the channels are perhaps better seen in respect to the embodiment of FIG. 5.

Figure 4:
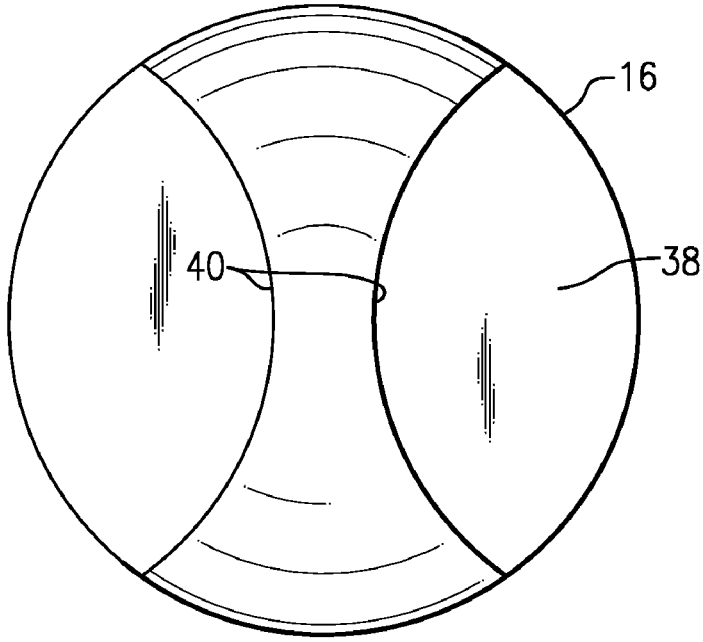
FIG. 4 is a bottom plan view of the rotary base member of this embodiment.

As shown in FIGS. 2 and 4, the rotatable base 16 is formed as a round disk-like member with a diameter corresponding to that of the inside of the jar body 12. In this embodiment, there is an annular ledge 36 at the lower end of the jar body interior, and the ledge 36 projects radially inward a small distance. The ledge 36 serves to retain the base 16 at the bottom of the jar body. In this embodiment, the annular ledge 36 defines the bottom opening 17. There is a recessed handle 38 formed in the bottom wall of the base 16, so that the bottom side of the base has an overall concave shape to allow the jar to stand on any convenient flat shelf, counter-top, or other work surface. The handle 38 includes a grip surface 40 to permit the user to conveniently grasp and twist the base 16. Also, as shown in FIG. 2, a ballast member 42, e.g., a ring of iron, is embedded in the base 16, and serves as a weight to help prevent the jar 10 from tipping after the contents have been elevated in the jar.

In this embodiment, the jar body 12 has a shoulder 52 that leads to a neck portion 54 that is of smaller diameter than the main, cylindrical body portion, and male threads 56 are formed at the upper end of the neck portion so as to receive corresponding threads on the jar lid 14.

Figure 5:
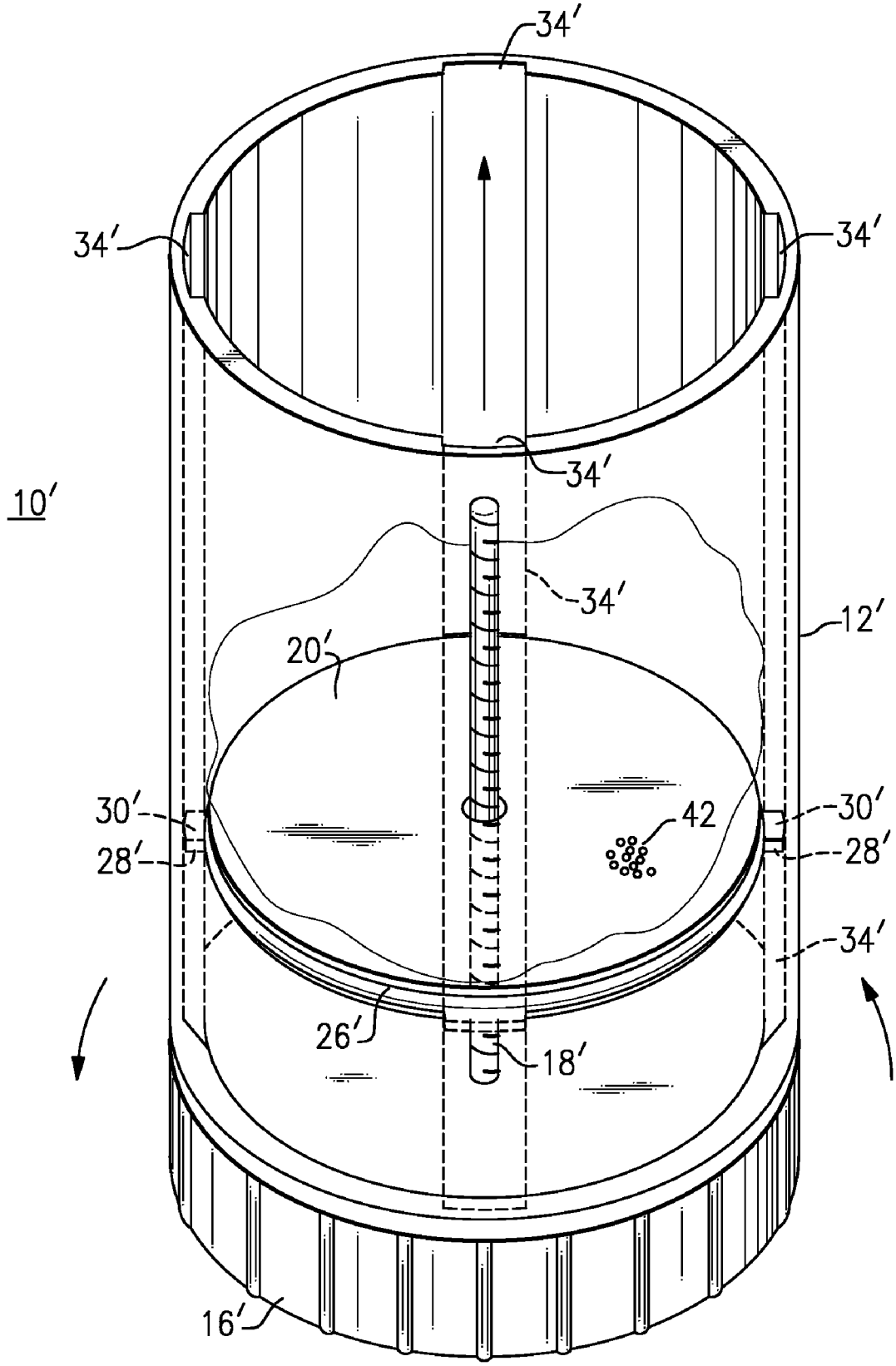
FIG. 5 is a perspective view of an alternative embodiment.

A second embodiment of this invention is illustrated in FIG. 5, in which structural elements that correspond to similar elements in the first embodiment are identified with the same reference number, but primed. A detailed description of these elements need not be repeated. In the second embodiment, the food container or jar 10' is of similar construction to the jar 10 of the first embodiment, except that the base 16' is seated below the bottom end of the jar body 12', and is adapted to be grasped and turned on its outside cylindrical surface, which can have knurls or ribs. Also, the jar body 12' has straight sides leading to the mouth at the top, rather than the shouldered structure and smaller diameter neck portion of the first embodiment. The vertical recessed channels 34' are similar to those of the first embodiment, but are better seen here. These mate with the lips of the platform 20' as discussed earlier, and the seal structure, e.g., the ring seal and lip seals, act in a similar fashion as with the first embodiment. A press-on lid (not shown) can fit onto the upper mouth of the jar 10'.

A push-up tab can be employed as an aid for removal of the lid. Also, for some applications optional small holes 42 can be provided in the platform 20 or 20' to allow pickle juice or olive juice, for example, to drain through as the user advances the contents. This makes it easier to extract the pickles or olives without spilling the liquid. In such case, the seal ring can be omitted, but seal structure can be included at the base.

The above-described embodiments are intended as containers for comestibles, i.e., food products such as those discussed earlier that have both liquid and solid components. However, these can also serve as containers for non-liquid foods, such as breakfast cereals, spices, etc., and can serve for liquid or mostly liquid products, such as pickles, olives, apple sauce, or fruit juices. The very same structure can be used in containers for non-food products, e.g., furniture polishes, paints, caulks or lubricants, shampoos, body cremes, liquid soaps, etc., where it is desired to make it more convenient to reach into the jar to access the contents after the jar is no longer full.

While the invention has been described and illustrated in respect to selected preferred embodiments, it should be appreciated that the invention is not limited only to those precise embodiment. Rather, many modifications and variations would present themselves to those of skill in the art without departing from the scope and spirit of this invention, as defined in the appended claims.

We claim:

1. Container for a food product that is a mixture of solid and liquid components, the container comprising a jar body having a generally cylindrical inside wall of a predetermined inside diameter, a mouth at a top thereof, and a bottom end, the jar body having a plurality of vertical channel recesses formed on said inside wall;

said bottom end having a bottom opening that is substantially the same diameter as said cylindrical inside wall;

a rotatable base fitted onto the bottom opening at said bottom end of the jar body and retained therein, and adapted to be rotated by hand about a center axis of the jar body, wherein said rotatable base is contained within the cylindrical body at a bottom end thereof;

a threaded post affixed to said base and extending along the center axis of the jar body; and a platform member which is slidable along the inside wall of said jar body to urge said food product towards the mouth of the jar body, the platform member including a generally rigid disk having a central female threaded opening engaging said threaded post;

an annular peripheral recess;

a flexible seal ring in said peripheral recess and being slidably biased against the inside cylindrical wall of said jar body, a plurality of radially extending lips which project into said channel recesses, respectively; and respective flexible seal members positioned on said radial lips and forming a slidable seal against the associated channel members.

2. The container according to claim 1 wherein said jar body cylindrical wall has a pair of said vertical channel recesses positioned diametrically opposite one another and said platform has a pair of said lips positioned diametrically opposite one another on said disk.

3. A container according to claim 1 wherein said jar member has four of said vertical channel recesses at ninety degree intervals and said platform has four of said lips positioned at ninety degree intervals.

4. A container according to claim 1 wherein rotatable base includes a ballast member providing weight to said base.

5. A container according to claim 1 wherein said jar body includes an internal annular ledge formed at the bottom end thereof for retaining said rotatable base therein.

6. A container for a food product that is a mixture of solid and liquid components, the container comprising a jar body having a generally cylindrical inside wall of a predetermined inside diameter, a mouth at a top thereof, and a bottom end, the jar body having a plurality of vertical channel recesses formed on said inside wall;

said bottom end having a bottom opening that is substantially the same diameter as said cylindrical inside wall;

a rotatable base fitted onto the bottom opening at said bottom end of the jar body and retained therein, and adapted to be rotated by hand about a center axis of the jar body, wherein said rotatable base is contained within the cylindrical body at a bottom end thereof;

a threaded post affixed to said base and extending along the center axis of the jar body; and a platform member which is slidable along the inside wall of said jar body to urge said food product towards the mouth of the jar body, the platform member including a generally rigid disk having a central female threaded opening engaging said threaded post;

an annular peripheral recess;

a flexible seal ring in said peripheral recess and being slidably biased against the inside cylindrical wall of said jar body, a plurality of radially extending lips which project into said channel recesses, respectively; and respective flexible seal members positioned on said radial lips and forming a slidable seal against the associated channel members;

wherein said rotatable base has a recessed handle grip formed at a bottom side thereof.

7. A container according to claim 1 wherein said jar body has a shoulder leading to a neck of smaller diameter than said cylindrical wall and on which said mouth is formed, with a threaded rim on said neck, and further comprising a screw-on lid threaded to mate with said threaded rim.

* * * * *